US008303329B2

(12) United States Patent
Wu

(10) Patent No.: US 8,303,329 B2
(45) Date of Patent: Nov. 6, 2012

(54) LOW PROFILE CABLE CONNECTOR ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/118,594

(22) Filed: May 31, 2011

(65) Prior Publication Data

US 2011/0294339 A1 Dec. 1, 2011

(51) Int. Cl.
*H01R 11/20* (2006.01)

(52) U.S. Cl. ..... 439/395; 439/607.01

(58) Field of Classification Search ..... 439/395, 439/607.01
See application file for complete search history.

(56) References Cited

U.S. PATENT DOCUMENTS 5,429,526 A * 7/1995 Ann ..... 439/417
5,944,559 A * 8/1999 Wu ..... 439/607.53
7,393,235 B2 * 7/2008 Lin ..... 439/391
7,422,488 B1 * 9/2008 Wu ..... 439/676
7,534,141 B1 * 5/2009 Wu ..... 439/607.01
7,534,143 B1 * 5/2009 Tsao et al. ..... 439/607.41
7,540,786 B1 * 6/2009 Koser et al. ..... 439/660
7,618,293 B2 * 11/2009 Wu ..... 439/660
7,717,733 B1 * 5/2010 Yi et al. ..... 439/452
7,798,850 B2 * 9/2010 Sabo et al. ..... 439/607.01
7,850,465 B1 * 12/2010 Wan et al. ..... 439/79
7,909,653 B1 * 3/2011 Wan et al. ..... 439/660
7,942,704 B2 * 5/2011 Ko et al. ..... 439/660
7,946,893 B2 * 5/2011 Chen et al. ..... 439/660
8,052,431 B1 * 11/2011 He et al. ..... 439/78
8,052,477 B1 * 11/2011 Ko ..... 439/660
8,083,546 B2 * 12/2011 Lee ..... 439/607.02
8,123,558 B2 * 2/2012 Su et al. ..... 439/607.01
8,133,079 B2 * 3/2012 He ..... 439/660
8,152,569 B2 * 4/2012 Chen et al. ..... 439/660
2003/0139095 A1 * 7/2003 Yang Lee ..... 439/607
2007/0270022 A1 * 11/2007 Lin ..... 439/425
2008/0311801 A1 * 12/2008 Chen et al. ..... 439/733.1
2009/0117784 A1 * 5/2009 Wu ..... 439/660
2009/0117785 A1 * 5/2009 Wu ..... 439/668
2009/0130906 A1 * 5/2009 Tsao et al. ..... 439/626
2010/0055980 A1 * 3/2010 Chen et al. ..... 439/607.01
2010/0124845 A1 * 5/2010 Sabo et al. ..... 439/607.01
2010/0144202 A1 * 6/2010 Yi et al. ..... 439/607.06
2010/0159751 A1 * 6/2010 Chiu et al. ..... 439/660
2010/0290745 A1 * 11/2010 Liao et al. ..... 385/90
2011/0021043 A1 * 1/2011 Lee ..... 439/78
2011/0053414 A1 * 3/2011 Wan et al. ..... 439/607.01

(Continued)

*Primary Examiner* — Ross Gushi
(74) *Attorney, Agent, or Firm* — Wei Te Chung; Ming Chieh Chang

(57) ABSTRACT

A cable connector assembly (100), comprising: an insulative housing (1), a plurality of first contacts (2) and second contacts (3) received in the insulative housing (1), and each first contact (2) comprising a front flat first mating portion (21) and a back first punctured portion (22), each second contact (3) comprising a first elastic second mating portion (31) and a back second punctured portion (32), the first mating portions (21) being arranged in front of the second mating portion (31), a cable (4) comprising a plurality of first wires (40) connected with the first contacts (2) and a plurality of second wires (41) connected with the second contacts (3), the first wires (40) and the second wires (41) arranged in a row and separated from each other, the first punctured portion (22) connecting with the first wires (40) by insulation displacement connection, the second punctured portion (32) connecting with the second wires (41) by insulation displacement connection.

18 Claims, 10 Drawing Sheets

U.S. PATENT DOCUMENTS

2011/0244733 A1* 10/2011 Ueda et al. ..... 439/660
2011/0250783 A1* 10/2011 Su et al. ..... 439/404
2011/0256764 A1* 10/2011 Wu ..... 439/607.01
2011/0263156 A1* 10/2011 Ko ..... 439/607.01
2011/0269322 A1* 11/2011 He et al. ..... 439/78
2011/0269345 A1* 11/2011 He ..... 439/626
2011/0281469 A1* 11/2011 Su et al. ..... 439/660
2011/0294339 A1* 12/2011 Wu ..... 439/391
2012/0009811 A1* 1/2012 He et al. ..... 439/345
2012/0009818 A1* 1/2012 Yao et al. ..... 439/607.23
2012/0015554 A1* 1/2012 Tseng ..... 439/607.01
2012/0020624 A1* 1/2012 Liao et al. ..... 385/77
2012/0021651 A1* 1/2012 Ho ..... 439/626
2012/0040567 A1* 2/2012 Ho ..... 439/660
2012/0045934 A1* 2/2012 Wu ..... 439/607.01
2012/0052709 A1* 3/2012 Ko ..... 439/345
2012/0052731 A1* 3/2012 Hsiao et al. ..... 439/620.22
2012/0071022 A1* 3/2012 Su et al. ..... 439/449

* cited by examiner

LOW PROFILE CABLE CONNECTOR ASSEMBLY

FIELD OF THE INVENTION

The present invention generally relates to a cable connector assembly, and more particularly to a low profile cable connector assembly.

DESCRIPTION OF RELATED ART

Nowadays, the cable connector assembly comprises an insulative housing, a plurality of contacts receiving in the insulative housing and a cable connecting with the contacts. The cable comprises a plurality of wires and an insulative jacket enclosing the wires, the wires connecting with the contacts by the soldering method in order to meet the connection between the cable and the contacts.

However, the soldering method is a tradition method to meet the connection between the contacts and the wires, but it still exist so many questions, such as wires are mingled together and more effort is needed to organized them. Furthermore, soldering process may result in pollution.

Correspondingly, it is desired to have a cable connector assembly with improved structure to address the problems stated above.

BRIEF SUMMARY OF THE INVENTION

Accordingly, an object of the present invention is to provide a cable connector assembly with low profile.

In order to achieve the above-mentioned object, A cable connector assembly, comprising: an insulative housing, a plurality of first contacts and second contacts received in the insulative housing, each first contact comprising a front flat first mating portion and a back first punctured portion, each second contact comprising a first elastic second mating portion and a back second punctured portion, the first mating portions being arranged in front of the second mating portions, a cable comprising a plurality of first wires connected with the first contacts and a plurality of second wires connected with the second contacts, the first wires and the second wires arranged in a row and separated from each other, the first punctured portion connecting with the first wires by insulation displacement connection, the second punctured portion connecting with the second wires by insulation displacement connection.

Other objects, advantages and novel features of the invention will become more apparent from the following detailed description of the present embodiment when taken in conjunction with the accompanying drawings.

DETAILED DESCRIPTION OF THE INVENTION

Figure 1:
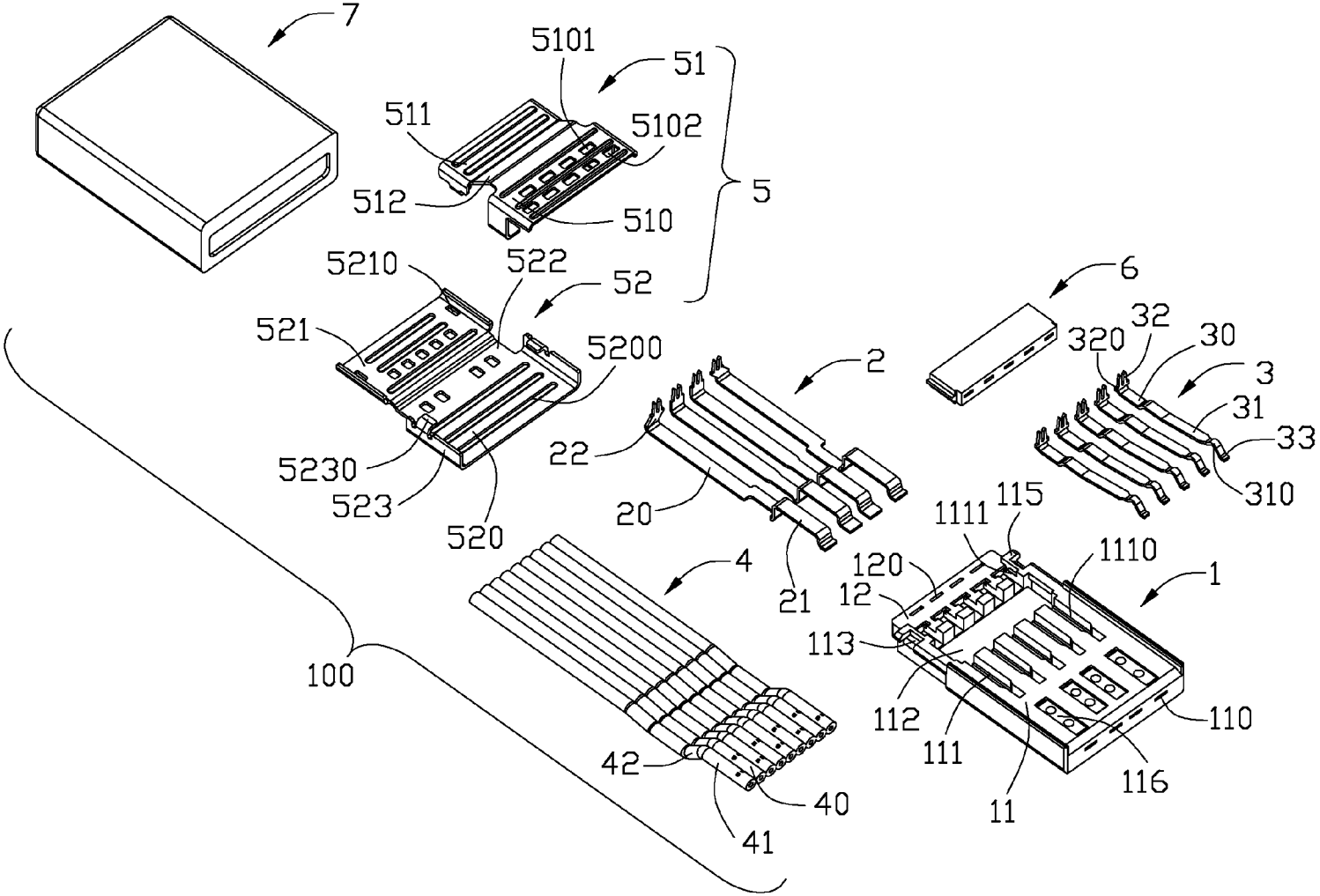
FIG. 1 is an exploded, perspective view of a cable connector assembly with the present invention.

Reference will now be made to the drawing figures to describe the present invention in detail.

Figure 2:
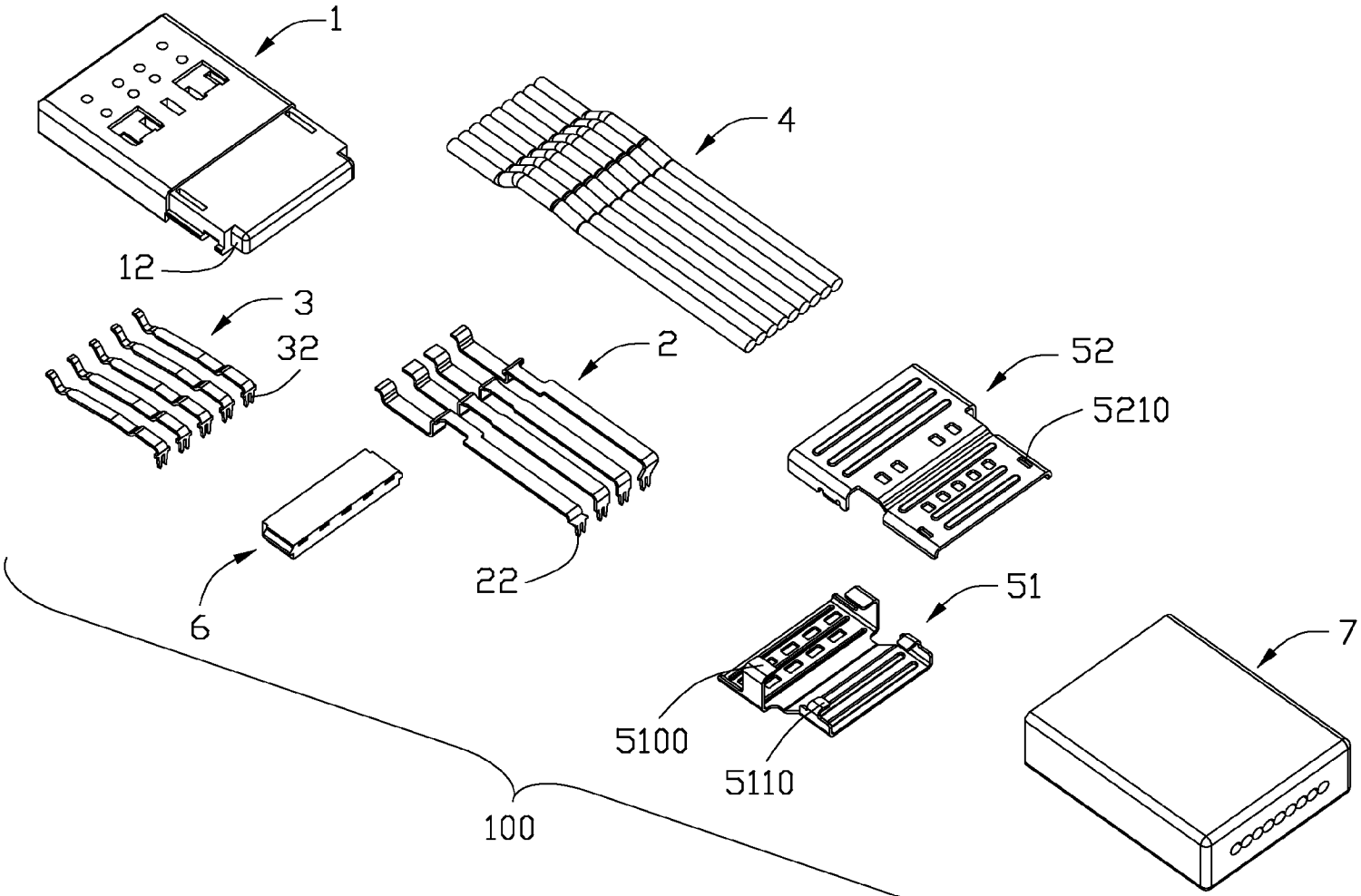
FIG. 2 is similar to FIG. 1, but viewed from another aspect.
Figure 3:
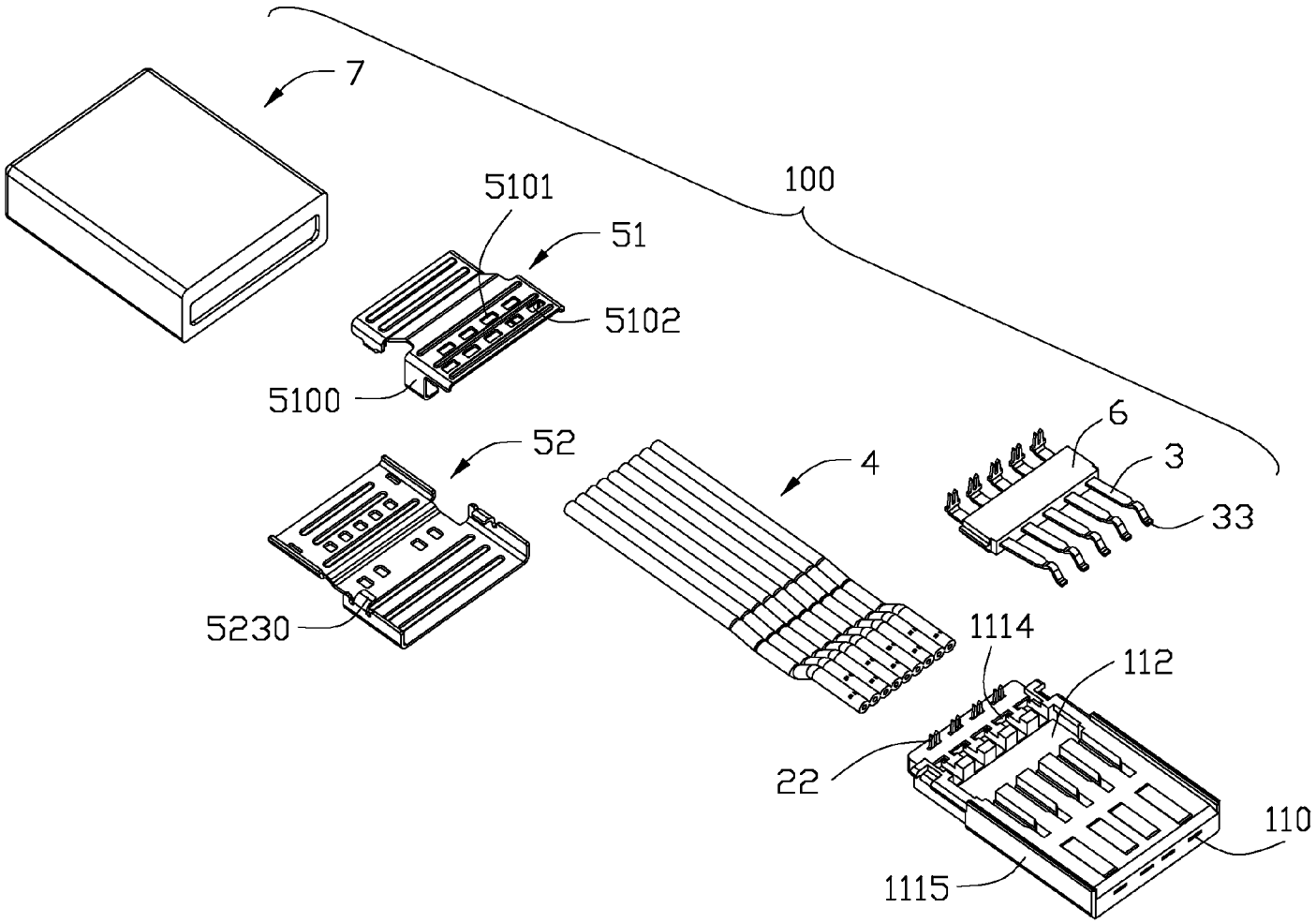
FIG. 3 is a perspective, partial assembled view of the cable connector assembly of FIG. 1.
Figure 4:
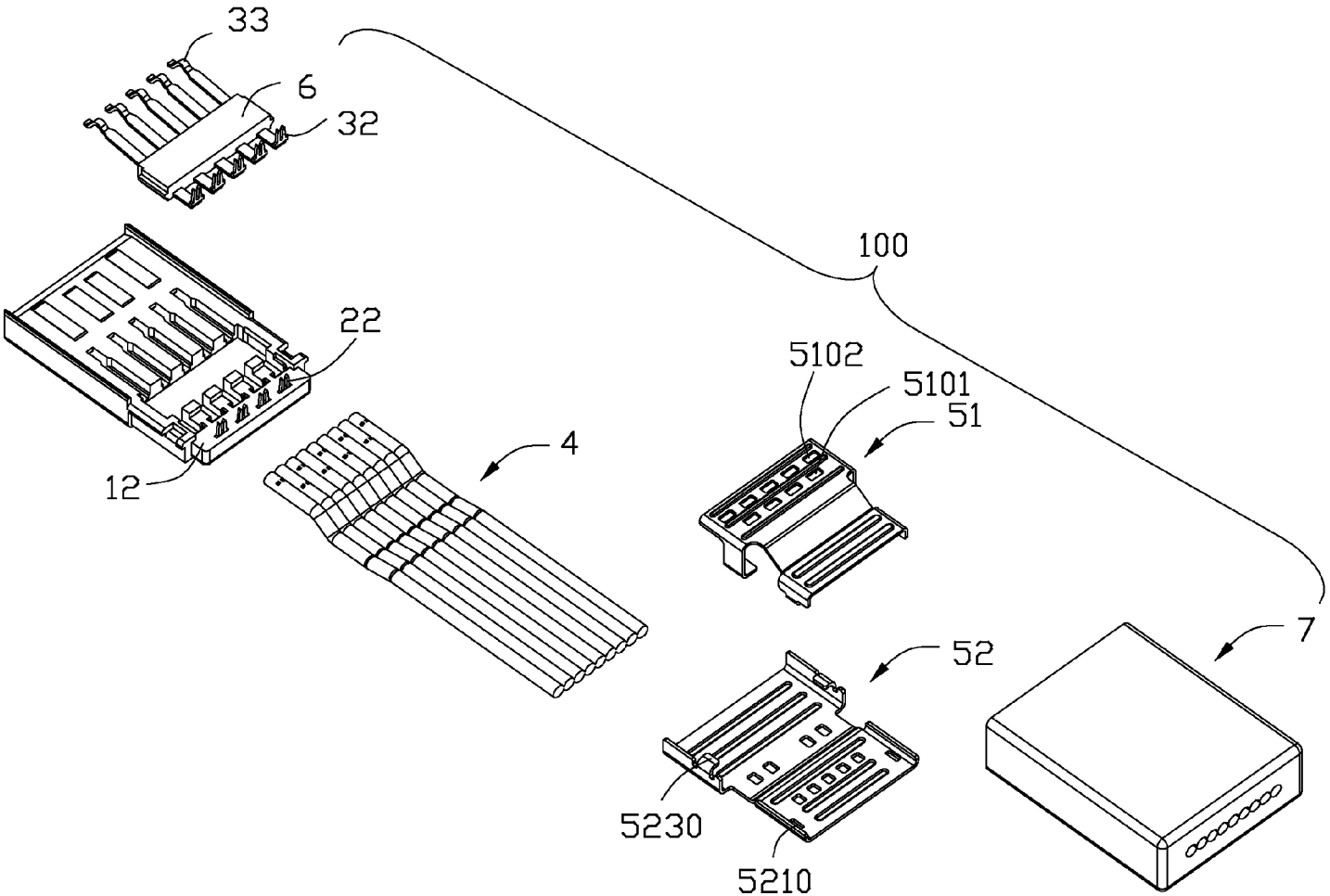
FIG. 4 is similar to FIG. 3, but viewed from another aspect.

Referring to FIG. 1 to 2, a cable connector assembly 100 in accordance with the present invention comprises a plurality of first contacts 2, an insulative housing 1 molding outside the first contacts 2, a plurality of second contacts 3 received in the insulative housing 1, a plurality of cables 4 connecting with the first contacts 2 and the second contacts 3 and a metallic shell 5 shielding outside the insulative housing 1.

Referring to FIG. 1 to 2, the insulative housing 1 is rectangular-shaped approximately, and the insulative housing 1 comprises a base portion 11 and a extension portion 12 extending rearwardly from the base portion 11. A pair of flange portions 1115 are formed in the lateral sides of the front edge of the insulative housing 1, and the flange portion 1115 extending beyond the upper surface of the insulative housing 1 along the perpendicularity direction. A plurality of terminal receiving passages 110 are depressed backwardly from the front surface of the insulative housing 1. A plurality of terminal receiving grooves 111 are depressed in the back edge of the upper surface of the base portion 11 for receiving the second contacts 3, the terminal receiving grooves 111 are departed from each other along the transverse direction. A step-shaped portion 114 is formed in the lower section of the front surface of the terminal receiving grooves 111 and extended forwardly and downwardly. The transverse surface of the step-shaped portion 114 is defined as a bottom wall 1113. A plurality of gaps 1114 are formed in the lateral sides of the terminal receiving grooves 111. A hollow 112 is depressed from the upper surface of the insulative housing 1 downwardly and the terminal receiving grooves 111 are divided into a front portion and a back portion by the hollow 112, and the front edge of the terminal receiving grooves 111 defined a plurality of first terminal receiving grooves 1110, the back edge of the terminal receiving grooves 111 defined a plurality of second terminal receiving grooves 1111. A plurality of hollow portion 120 is depressed from the upper surface downwardly of the extension portion 12. A pair of locking holes 113 are recessed downwardly from the two side walls of the upper surface of the base portion 11. A pair of bumps 115 are formed in the two lateral walls of the base portion 11 and extending outwardly.

Referring to FIGS. 1 to 2, the number of the first contacts 2 is four, and each first contact 2 comprises a retention portion 20, a non-elastic first mating portion 21 extending upwardly and forwardly from the retention portion 20 and a first punctured portion 22 extending upwardly from the end of the retention portion 20. The mating portion 21 of the first contacts 2 are received in the terminal receiving passages 110 and the upper surface of the mating portions 21 are exposed in the grooves 116, and the first punctured portion 22 received in the hollow portions 120 and the first punctured portion 22 extending beyond the upper surface of the hollow portions 120.

Referring to FIG. 1 to 2, the number of the second contacts 3 is five, each second contact 3 comprises a base portion 30, a second punctured portion 32 extending upwardly from the rear end of the base portion 30 and a elastic second mating portion 31 extending forwardly from the base portion 31. A plurality of protruded portions 320 are formed in the end of the second punctured portion 32 and the protruded portions 320 are received in the gaps 1114 in order to fix the second contacts 3 in the terminal receiving grooves 111. A tail end 33 is formed in front end of the second mating portions 31 and extending forwardly.

Referring to FIG. 1 to 2, the cable connector assembly 100 also comprises a spacer 6 and the spacer 6 molded outside the back-section of the base portion 30 of the second contacts 3.

Figure 5:
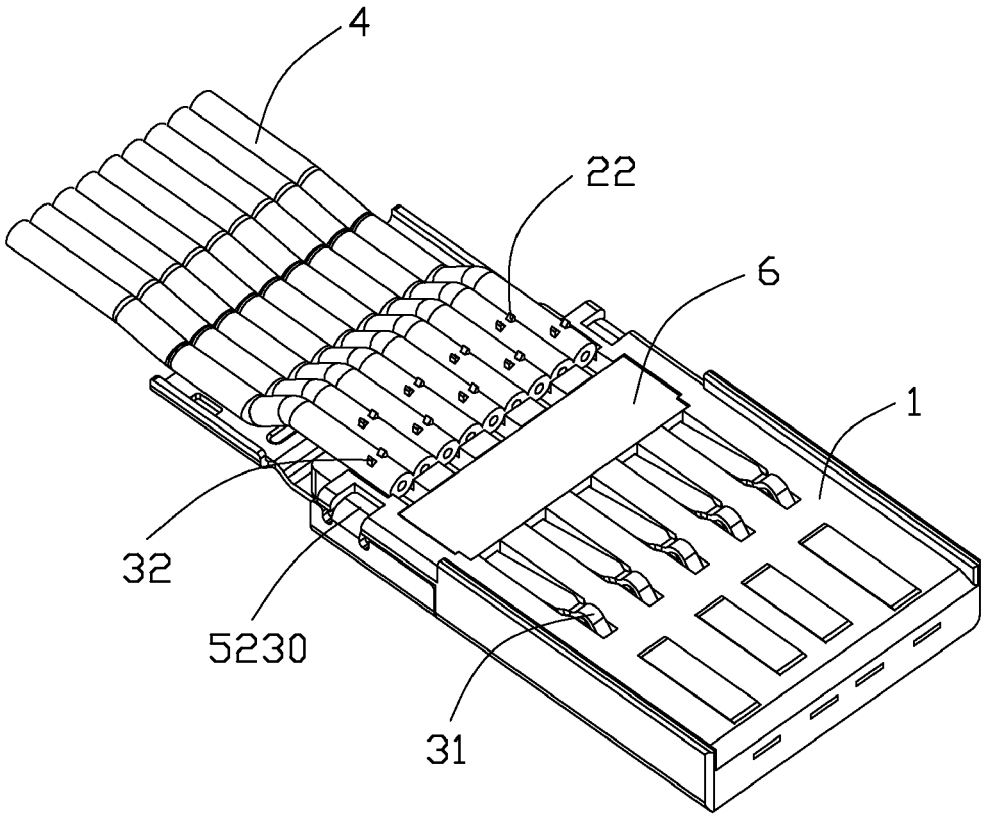
FIG. 5 is an another perspective, partial assembled view of the cable connector assembly of FIG. 1.
Figure 6:
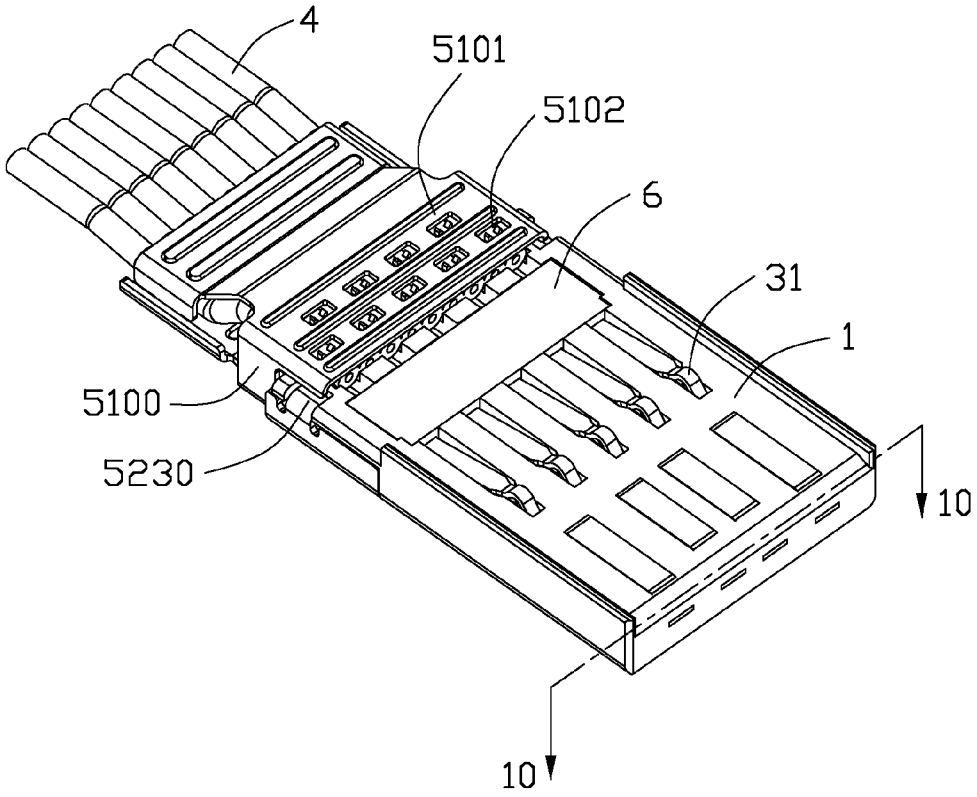
FIG. 6 is similar to FIG. 5, but viewed from another aspect.
Figure 7:
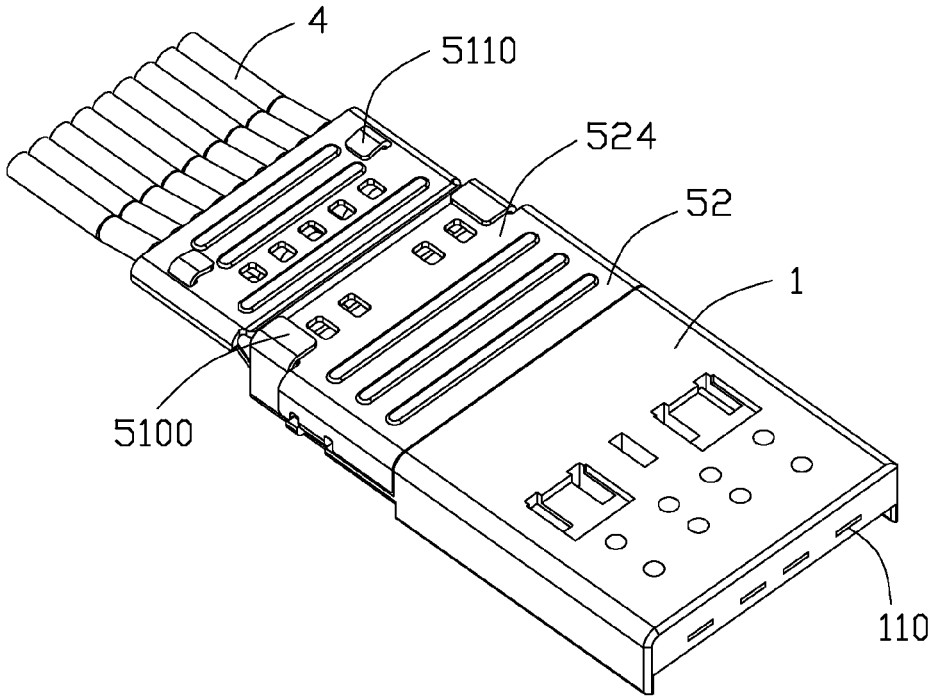
FIG. 7 is an another perspective, partial assembled view of the cable connector assembly of FIG. 6.
Figure 8:
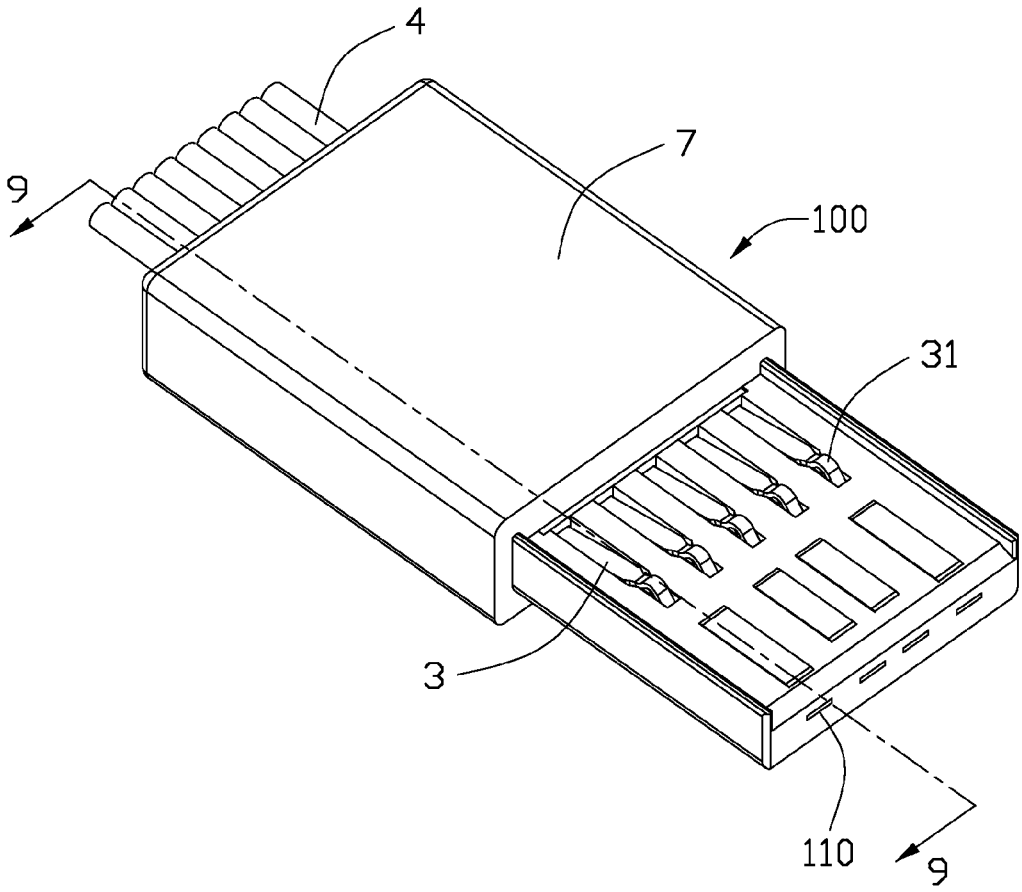
FIG. 8 is an assembled, perspective view of the cable connector assembly of FIG. 1.
Figure 9:
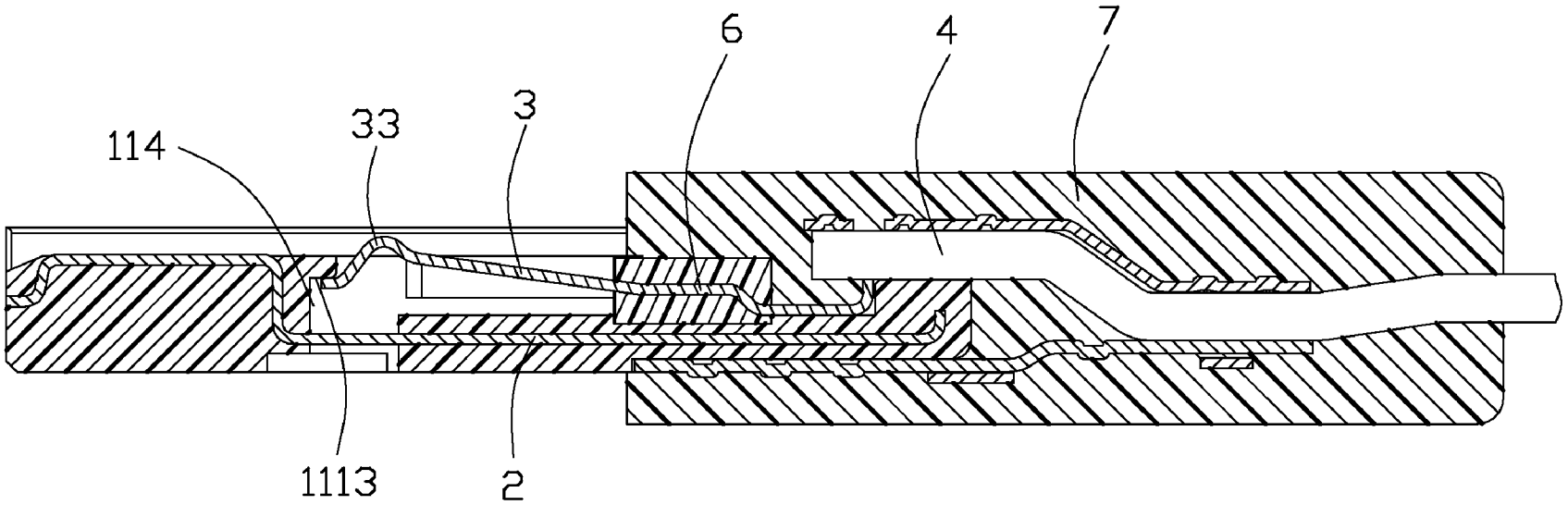
FIG. 9 is a cross-sectional view of the cable connector assembly taken along line 9-9 of FIG. 8.
Figure 10:
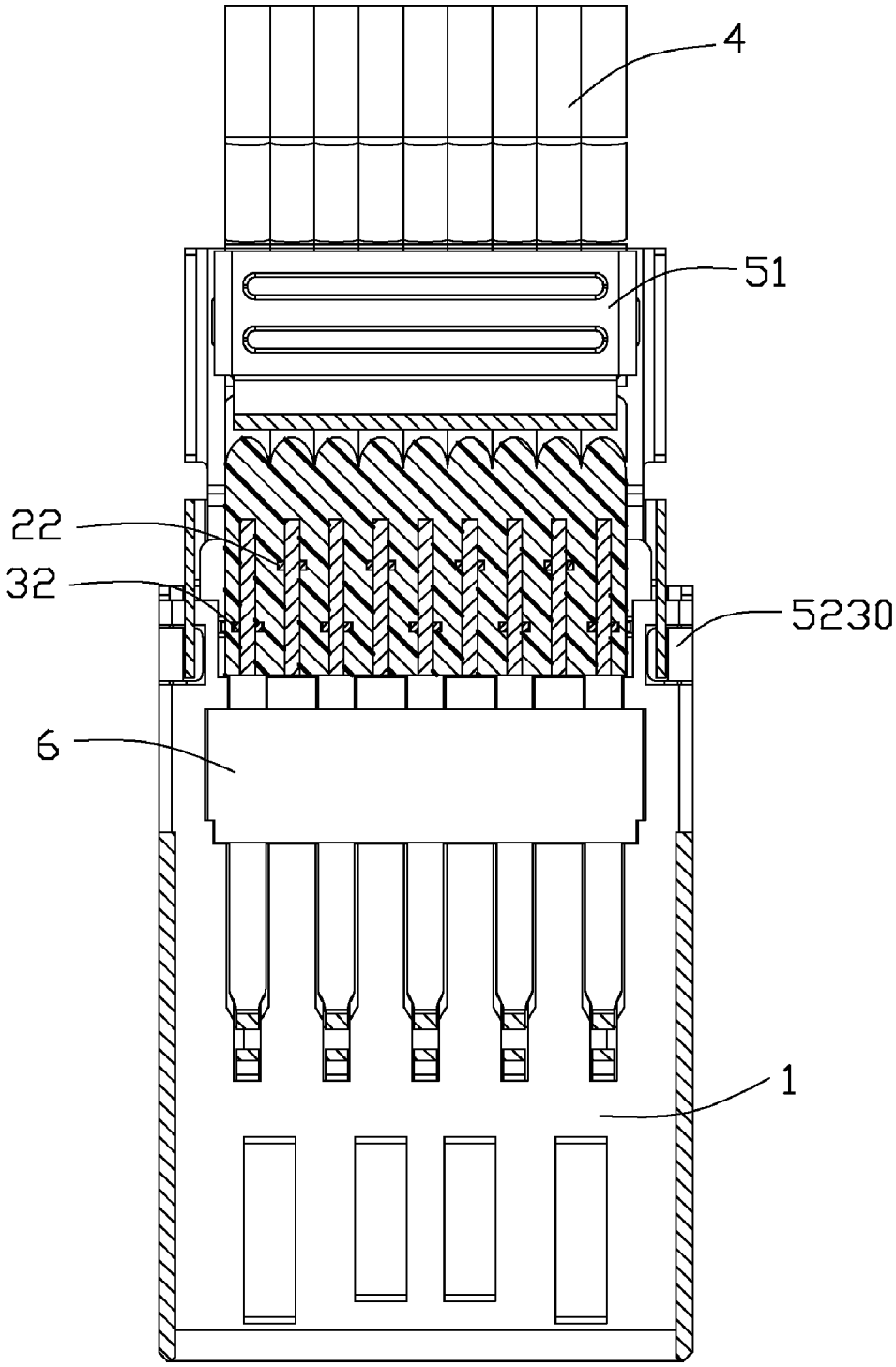
FIG. 10 is a cross-sectional view of the cable connector assembly taken along line 10-10 of FIG. 6.

Referring to FIG. 1 to 2 and conjunction with the FIG. 5, the cables 4 are arranged in a row, and the cables 4 comprise a plurality of first wires 40 connecting with the first punctured portion 22 and a plurality of second wires 41 connecting with the second punctured portion 32, the first wires 40 and the second wires 41 are arranged in a row and the first wires 40 and the second wires 41 are separated from each other. The front end of the first wires 40 and the second wires 41 are bended upwardly and the bending portions of the first wires 40 and the second wires 41 are defined as bending portion 42.

Referring to FIG. 1 to 2, the metallic shell 5 comprises a top shell 51 and a bottom shell 52 assembled to each other along a vertical direction. The top shell 51 comprises a shielding portion 510 and a extending portion 511 extending rearwardly from the shielding portion 510. A connection portion 512 is formed between the shielding portion 510 and the extending portion 511 for supporting the bending portions 42. A pair of first tabs 5100 are formed in the lateral sides of the shielding portion 510 and the first tabs 5100 extending downwardly and inwardly. A plurality of first slots 5101 are formed in the shielding portion 510 for receiving the first punctured portion 22 and a plurality of second slots 5102 lied in the front of the first slots 5101 for receiving the second punctured portion 32. A pair of second tabs 5110 are formed in the lateral walls of the extending portion 511 and the second tabs 5110 extending inwardly. The bottom shell 52 comprises a shielding portion 520 enclosing the back segment of the insulative housing 1, a supporting portion 521 located behind the shielding portion 520 for supporting the cables 4 and a connection portion 522 between the shielding portion 520 and the supporting portion 521 for supporting the tongue portion 12. A plurality of ribs 5200 are formed in the upper surface of the shielding portion 520. A pair of third tabs 5230 are formed in the lateral walls of the bottom shell 52 for mating with the locking holes 113. A pair of slots 5210 are formed in the lateral sides of the lower surface of the supporting portion 521 for mating with the second tabs 5110.

Referring to FIG. 1 to 2 and conjunction with FIG. 3 to 10, in assembled with the cable connector assembly 100, the first contacts 2 are received in the insulative housing 1 via the insert-molsing process, and the first contacts 2 are received in the terminal receiving passages 110 and the first punctured portion 22 of the first contacts 2 are received in the hollows 120 portion and the first punctured portion 22 are extended beyond the upper surface of the hollows portion 120. The spacer 6 molded outside the second contacts 3 and assembled onto the upper surface of the insulative housing 1, the base portion 30 of the second contacts 3 are received in the second terminal receiving grooves 1111 and the second mating portion 31 are received in the first terminal receiving grooves 1110, the tail end 33 of the second contacts 3 are received in the front edge of the first terminal receiving grooves 1110. And the spacer 6 is installed in the hollow 112, the top of the second mating portion 31 of the second contacts 3 is lower than the upper surface of the flange portion 1115 in order to make the second contacts 3 not connect with the mating connector. And then the bottom shell 52 is assembled into the lower surface of the insulative housing 1 and the bottom shell 52 is assembled behind the flange portion 1115, and the third tabs 5230 are received in the locking holes 113 and the tongue portion 12 is supported on the connection portion 522, the bottom shell 52 is disposed behind the flange portion 1115 and enclosed to the flange portion 1115. Then the cables 4 are arranged in the supporting portion 521, the cables 4 are connected with the contacts by the method of IDC. Also we can see the cables 4 connecting with the first contacts 2 are separated with the cables 4 connecting with the second contacts 3, then the top shell 51 is assembled to the bottom shell 52 along a vertical direction perpendicular to the mating portion, the second tabs 5110 are locked into the slots 5210, the first tabs 5100 are disposed behind the flange portion 115 and enclosing the bottom surface of the bottom shell 52, and the first punctured portions 22 are received in the first slots 5101, and the second punctured portions 32 are received in the second slots 5102, and the cover 7 is molded outside of the back of the insulative housing 1, the conjunction portion of the cables 4 and the first contacts 2 and the second contacts 3 and partial of the cable 4. Thus, the cable connector assembly 100 is assembled.

The cable connector assembly comprises a flat-shaped cable 4 for connecting with the first contacts 2 and the second contacts 3. Because of the first contacts 2 and the second contacts 3 connecting with the cables 4 by the method of IDC, so the cable connector assembly 100 become low profile and meet with the requirement of the development of the cable connector assembly.

What is claimed is:

1. A cable connector assembly, comprising:

an insulative housing;

a plurality of first contacts and second contacts received in the insulative housing, each first contact comprising a front flat first mating portion and a back first punctured portion, each second contact comprising a first elastic second mating portion and a back second punctured portion, the first mating portions being arranged in front of the second mating portions;

a cable comprising a plurality of first wires connecting with the first contacts and a plurality of second wires connecting with the second contacts, the first wires and the second wires arranged in a row and separated from each other, the first punctured portion connected with the first wires by insulation displacement connection, the second punctured portion connected with the second wires by insulation displacement connection.

2. The cable connector assembly as claimed in claim 1, wherein the first punctured portions are arranged behind the second punctured portions and the first punctured portions are separated from the second upered portions.

3. The cable connector assembly as claimed in claim 2, wherein the first contacts are received in the insulative housing via the insert-molding process.

4. The cable connector assembly as claimed in claim 3, wherein the second contacts are assembled to the insulative housing along a up-to-down direction.

5. The cable connector assembly as claimed in claim 4, wherein the cable connector assembly also comprises a metallic shell shielding outside the insulative housing, and the metallic shell comprises a top shell and a bottom shell assembled to each other along a vertical direction.

6. The cable connector assembly as claimed in claim 5, wherein a plurality of first slots are formed in the top shell for receiving the first punctured portions and a plurality of second slots arranged behind the first slits for receiving the second punctured portions.

7. The cable connector assembly as claimed in claim 6, wherein a pair of flange portions are formed in the lateral walls and the bottom wall of the insulative housing and the top of the second mating portions of the second contacts are not beyond the upper surface of the insulative housing.

8. The cable connector assembly as claimed in claim 7, wherein the front end of the first wires and the second wires are bended upwardly and the bending portion of the first wires and the second wires are defined as bending portion.

9. The cable connector assembly as claimed in claim 8, wherein a connection portion is formed in the top shell for supporting the bending portion.

10. The cable connector assembly as claimed in claim 1, wherein a plurality of terminal receiving passages are depressed backwardly from the front surface of the insulative housing.

11. The cable connector assembly as claimed in claim 10, wherein a plurality of terminal receiving grooves are depressed in the back edge of the insulative housing for receiving the second contacts, and the second punctured portions extended beyond the upper surface of the insulative housing.

12. The cable connector assembly as claimed in claim 11, wherein a pair of gaps are formed in the lateral sides of the terminal receiving grooves.

13. The cable connector assembly as claimed in claim 12, wherein a air of protrude portions are formed in the lateral sides of the second punctured portions and the protrude portions are received in the gaps in order to fix the second contacts in the terminal receiving grooves.

14. A cable connector assembly comprising:

an insulative housing integrally formed with a plurality of first contacts each having a planar contacting section and an IDC (Insulation Displacement Contact) tail section in a front-to-back direction;

a terminal module integrally formed with a plurality of second contacts each having a deflectable contacting section and an IDC tail section in the front-to-back direction;

the terminal module assembled to the housing under condition that the planar contacting sections are located in front of the deflectable contacting sections and the IDC tail sections of the second contacts are located in front of those of the first contacts;

a plurality of wires side by side arranged in one row along a transverse direction, perpendicular to said front-to-back direction, behind the housing and pierced by the corresponding IDC tail sections, respectively.

15. The cable connector assembly as claimed in claim 14, wherein the terminal module includes an insulator holding the second contacts.

16. The cable connector assembly as claimed in claim 15, wherein said insulator is received in a cavity in the housing.

17. The cable connector assembly as claimed in claim 16, further including a metallic shell enclosing a front portions of the wires and a rear portion of the housing.

18. The cable connector assembly as claimed in claim 17, further including an insulative covering overmolded upon the shell.

* * * * *